US010400388B2

(12) United States Patent
Matsubara et al.

(10) Patent No.: US 10,400,388 B2
(45) Date of Patent: Sep. 3, 2019

(54) DAMAGE PROCESS FOR A TEXTILE PRODUCT

(71) Applicant: FAST RETAILING CO., LTD., Yamaguchi-shi, Yamaguchi (JP)

(72) Inventors: Masaaki Matsubara, Los Angeles, CA (US); Darwin Dumpit, Los Angeles, CA (US)

(73) Assignee: FAST RETAILING CO., LTD., Yamaguchi (JP)

( * ) Notice: Subject to any disclaimer, the term of this patent is extended or adjusted under 35 U.S.C. 154(b) by 8 days.

(21) Appl. No.: 15/798,690

(22) Filed: Oct. 31, 2017

(65) Prior Publication Data

US 2019/0127906 A1 May 2, 2019

(51) Int. Cl.

| | |
|---|---|
| ***D06M 10/04*** | (2006.01) |
| ***D06L 3/04*** | (2006.01) |
| ***D06M 10/00*** | (2006.01) |
| ***D06P 5/13*** | (2006.01) |
| ***D06P 5/15*** | (2006.01) |

(Continued)

(52) U.S. Cl.

CPC ..... *D06M 10/04* (2013.01); *D06L 4/50* (2017.01); *D06M 10/005* (2013.01); *D06P 5/132* (2013.01); *D06P 5/137* (2013.01); *D06P 5/153* (2013.01); *D06P 5/158* (2013.01); *D06P 5/2005* (2013.01); *D06P 7/00* (2013.01); *D06Q 1/02* (2013.01); *D10B 2201/02* (2013.01)

(58) Field of Classification Search

None

See application file for complete search history.

(56) References Cited

U.S. PATENT DOCUMENTS

| | | | |
|---|---|---|---|
| 4,536,182 | A | 8/1985 | Tatin |
| 4,575,887 | A | 3/1986 | Viramontes |

(Continued)

FOREIGN PATENT DOCUMENTS

| | | | |
|---|---|---|---|
| EP | 1 431 437 | A1 | 6/2004 |
| JP | 4-100987 | A | 4/1992 |

(Continued)

OTHER PUBLICATIONS

English text translation of Tashiro et al. ( JP 04-100987 A), accessed from Espacenet website, copy attached as a PDF pp. 1-6. (Year: 1992).*

(Continued)

*Primary Examiner* — Katie L. Hammer

(74) *Attorney, Agent, or Firm* — Finnegan, Henderson, Farabow, Garrett & Dunner, LLP

(57) ABSTRACT

A damage process for a textile product may include, but is not limited to, irradiating a laser beam onto a surface region of a textile product which is dyed, to burn the surface region, exposing the textile product to an ozone gas; and agitating the textile product together with at least one of: pieces of one or more solid materials having uneven surfaces and one or more abrasives of artificial fibers to allow the surface region to be shaved by the at least one of: the pieces of one or more solid materials and the one or more abrasives of artificial fibers. One or more subsequent processes can be carried out, without dipping the textile product into water or a liquid of chemicals, after agitating the textile product and until softening the textile product.

5 Claims, 2 Drawing Sheets

(51) Int. Cl.

| | |
|---|---|
| ***D06P 5/20*** | (2006.01) |
| ***D06P 7/00*** | (2006.01) |
| ***D06Q 1/02*** | (2006.01) |
| ***D06L 4/50*** | (2017.01) |

(56) References Cited

U.S. PATENT DOCUMENTS

| | | | | |
|---|---|---|---|---|
| 4,750,227 | A | 6/1988 | Hopkins et al. | |
| 4,900,323 | A | 2/1990 | Dickson et al. | |
| 5,215,543 | A | 6/1993 | Milora et al. | |
| 5,331,773 | A | 7/1994 | Biancalani et al. | |
| 5,461,742 | A | 10/1995 | Pasad et al. | |
| 5,567,207 | A * | 10/1996 | Lockman | D06B 11/0096 8/115.52 |
| 5,595,572 | A * | 1/1997 | Millington | D06M 10/001 8/103 |
| 5,613,983 | A * | 3/1997 | Terry | D06B 11/0096 8/102 |
| 5,916,461 | A | 6/1999 | Costin et al. | |
| 5,990,444 | A | 11/1999 | Costin | |
| 6,753,501 | B1 | 6/2004 | Costin, Sr. et al. | |
| 2002/0032931 | A1 | 3/2002 | Teran et al. | |
| 2004/0148866 | A1 * | 8/2004 | Krupnick | B24D 11/001 51/295 |
| 2012/0276821 | A1 | 11/2012 | Richardiere et al. | |

FOREIGN PATENT DOCUMENTS

| | | | |
|---|---|---|---|
| JP | 10-102386 | A | 4/1993 |
| JP | 5-69197 | U | 9/1993 |
| JP | 5-247857 | A | 9/1993 |
| JP | 6-316858 | | 11/1994 |
| JP | 2008-274489 | A | 11/2008 |
| WO | WO 95/13415 | | 5/1995 |
| WO | WO 99/01602 | | 1/1999 |
| WO | WO 2009/045183 | A1 | 4/2009 |
| WO | WO 2012/119532 | A1 | 9/2012 |
| WO | WO 2013/186687 | A1 | 12/2013 |
| WO | WO 2016/033367 | A1 | 3/2016 |

OTHER PUBLICATIONS

Joy Sarker et al., Effect of Enzyme Washing Combined with Pumice Stone on the Physical, Mechanical and Color Properties of Denim Garments, International Journal of Research in Advent Technology, vol. 2, No. 9, Sep. 2014.

Azmary Akter Mukthy et al., Effect of Resin Finish on Cotton Bended Woven Fabrics, International Journal of Scientific Engineering and Technology, vol. No. 3, Issue, No. 7, pp. 983-990.

T. Dekanic et al., Influence of special finishes on denim properties, Indian Journal of Fibre & Textile Research, vol. 40, Jun. 2015. pp. 170-174.

International Search Report issued in PCT/JP2018/024749 dated Sep. 18, 2018.

International Search Report issued in PCT/JP2018/02479 dated Sep. 18, 2018.

Extended European Search Report issued in EP 18179084.1 dated Jan. 18, 2019.

Communication from Government of the People's Republic of Bangladesh, Department of Patents, Designs & Trademarks, issued in Patent Application No. 167/2018, dated Feb. 17, 2019.

Notification of Date of Publication of Search Report and Filing of Examination Request, including Search Report, issued by The Eurasian Patent Organization in Application No. 201891233/25, dated Feb. 11, 2019.

* cited by examiner

DAMAGE PROCESS FOR A TEXTILE PRODUCT

TECHNICAL FIELD

Embodiments of the present invention generally relate to a damage process for a textile product. More particularly, embodiments of the present invention relate to a method for decolorizing a textile product or a dyed cotton fabric such as a denim fabric.

BACKGROUND ART

In general, a textile product such as a dyed denim fabric has been decolorized to create a used and abused appearance in the dyed cotton fabric such as denim fabric. FIG. 1 is a flow chart of a fabric decolorization method in the related art. The fabric decolorization method includes a series of dry processes and a subsequent series of wet processes.

Dry Processes:

The dry processes include the following first to third steps, Step C1, Step C2, and Step C3. In Step C1, a hand shaving whisker process is carried out by shaving in hand the dyed cotton fabric such as denim fabric and/or whiskering in hand the dyed cotton fabric such as denim fabric. In Step C2, a hand-sand process is carried out by rubbing in hand a sand-paper on the cotton fabric such as denim fabric. The initial two processes, the hand shaving whisker process in Step C1 and the hand-sand process in Step 2, are carried out to create a vintage look of the dyed cotton fabric such as denim fabric. In Step C3, a potassium permanganate solution is sprayed to fade out the dyed color of indigo, for example, of the cotton fabric such as denim fabric. This process for spraying the potassium permanganate solution in Step C3 is carried out to make whiten the dyed cotton fabric such as denim fabric in addition to the initial two processes, the hand shaving whisker process in Step C1 and the hand-sand process in Step 2.

The dry processes are time-consuming and costly processes since the dry processes are carried out in hand or manually. For a piece of dyed cotton fabric such as denim fabric, each of the hand shaving whisker process in Step C1 and the hand-sand process in Step 2 will take about 10 min. and the potassium permanganate solution spraying process in Step C3 will take about 2 min. The hand shaving process in Step C1 will allow 15,000 pieces of dyed cotton fabric such as denim fabric to be treated manually by 140 people per day. The hand whisker process in Step C1 will allow 15,000 pieces of dyed cotton fabric such as denim fabric to be treated manually by 60 people per day. The potassium permanganate solution spraying process in Step C3 will allow 15,000 pieces of dyed cotton fabric such as denim fabric to be treated manually by 80 people per day. In total, the dry processes will take 3 days with 280 people to manually treating 15,000 pieces of dyed cotton fabric such as denim fabric. Thus, the estimation of the cost for the dry processes will be about 1.5 US Dollars per a piece of dyed cotton fabric such as denim fabric.

Wet Process:

The wet process includes the following fourth to eleventh steps, Step C4 through Step C11, subsequent to the above-described first to third steps, Step C1 to Step C3. In Step C4, a desizing process as a pre-washing process is carried out using a detergent and a desizing agent at a temperature of, for example, but not limited to, 60° C. for about 20 min. for removal of the Size material such as starch from the sized cotton fabric such as denim fabric. The desizing process is carried out to facilitate penetration, into the sized cotton fabric such as denim fabric, of chemicals and dyes applied during subsequent washing processes for fading the dyed color of the cotton fabric. In case of a cotton fabric of a weight of 60 kg, the desizing process is carried out using 600 liters of water and then a rinsing process is carried out using 600 liters of water. In total, 1200 liters of water need to be used for desizing process at 60 kg garment weight in Step C4.

In Step C5, a combined-stone-enzyme-washing process for washing the desized cotton fabric is carried out at a temperature in the range of 30-45° C., for example, but not limited to, preferably about 40° C. for about 35 min. using pumice stones in the presence of an enzyme such as an acid enzyme with 600 liters of water to modify the appearance, to impart worn-out look and to improve the comfort ability of the cotton fabric, especially denim fabric. Enzyme washing of the desized denim fabric helps in bio-polishing and to fade as a whole the dyed color of the designed cotton fabric such as denim fabric to a desired degree depending on the processing time and conditions. Adding pumice stone with the enzyme will extend the degree of fading and add special effect in the multi ply areas like different seams and hems. The combined stone enzyme washing process is carried out using 600 liters of water and then a rinsing process is carried out using 600 liters of water. In total, 1200 liters of water need to be used for color-fading process at 60 kg garment weight in Step C5.

In Step C6, a dry process for drying the washed cotton fabric is carried out in a dry air at a temperature in the range of 60-85° C., for example, but not limited to, preferably about 85° C. for about 45 min.

In Step C7, in order to achieve better hand-feeling of the garment, a chemical treatment process for dipping the dried cotton fabric into chemicals is carried out for about 45 min, as a wrinkle free finishing that is widely used to impart wrinkle-resistance to cotton fabrics. Crosslinking agent, catalyst, additives, and surfactants are used. It has been known that crosslinking agents will change woven and knitted fabrics composed of cellulosic fibers and their blends with synthetic fibers in such a way that the resulting textiles are easier to care for. It allows the reaction to be carried out within the 130-180° C. temperature range usually employed in the textile industry, and within the usual curing times. Three classes of catalysts are distinguished in the dry crosslinking process commonly used such as ammonium salts, e. g. ammonium chloride, sulfate and nitrate; metal salts, e. g. magnesium chloride, zinc nitrate, zinc chloride, aluminum sulfate and aluminum hydroxyl-chloride; and catalyst mixtures, e. g. magnesium chloride with added organic and inorganic acids or acid donors. The additives is to offset partly or completely the adverse effects of the crosslinking agent. Typical examples of the additives may include, but are not limited to, polymers based on acrylic monomers, vinyl monomers, siloxanes, amides, urethanes and ethylene; low-molecular substances such as fatty acid derivatives and quaternary ammonium compounds; and mixtures of these substances. Surface-active substances are necessary to ensure that the fabric is wet rapidly and thoroughly during padding and to stabilize the recipe components and liquors.

In Step C8, a neutralization process is carried out for about 8 min. by using 600 liters of water and then a rinsing process is carried out using 600 liters of water. In total, 1200 liters of water need to be used for the neutralization process at 60 kg garment weight in Step C8.

In Step C9, a chemical removing process as a clean-up process for removing from the cotton fabric the chemicals used in Step C7 is carried out for about 10 min. by using 600 liters of water and then a rinsing process is carried out using 600 liters of water. In total, 1200 liters of water need to be used for the chemical removing process at 60 kg garment weight in Step C9.

In Step C10, an enzyme treatment process for fading color of the cotton fabric with worn and aged effects is carried out for about 20 min. by using 600 liters of water and then a rinsing process is carried out using 600 liters of water. In total, 1200 liters of water need to be used for the enzyme treatment process at 60 kg garment weight in Step C10.

In Step C11, to make a hand-feel soft of the cotton fabric, a softening process for softening the color-fade cotton fabric with any available softener is carried out for about 5 min, by using 600 liters of water and then a rinsing process is carried out using 600 liters of water. In total, 600 liters of water need to be used for the softening process at 60 kg garment weight in Step C11.

Water Consumption:

In total, 7200 liters of water need to be used in the wet process for decolorization from Steps C4 to C11 at 60 kg garment weight for 30 pieces of cotton fabric, and total operating time is 188 min. for 30 pieces of cotton fabric.

Cost:

For 30,000 pieces of cotton fabric, 10 machines are used for 33.3 days. The estimated cost for the wet process is about 1.5 US Dollars for each piece of cotton fabric. The estimated total cost for the dry process and the wet process is about 3.0 US Dollars for each piece of cotton fabric.

SUMMARY

In some aspects, a damage process for a textile product may include, but is not limited to, irradiating a laser beam onto a surface region of a textile product which is dyed, to burn the surface region, exposing the textile product to an ozone gas; and agitating the textile product together with at least one of pieces of one or more solid materials having uneven surfaces and one or more abrasives of artificial fibers to allow the surface region to be shaved by the at least one of: the pieces of one or more solid materials and the one or more abrasives of artificial fibers. One or more subsequent processes can be carried out, without dipping the textile product into water or a liquid of chemicals or without exposing the textile product to a flow of water or chemical liquid, after agitating the textile product and until softening the textile product.

DESCRIPTIONS

Embodiments

Figure 1:
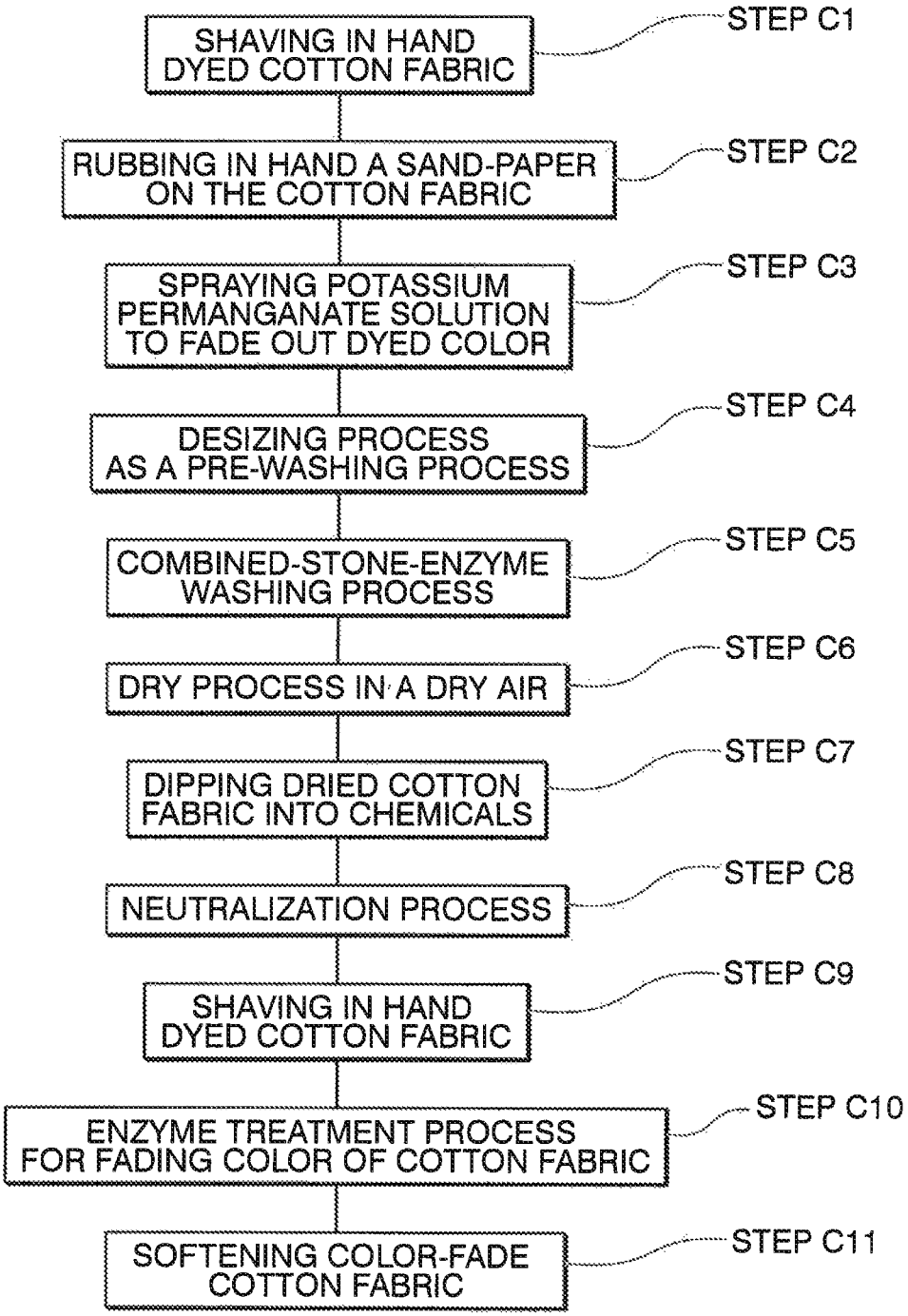
FIG. 1 RELATED ART
FIG. 1 is a flow chart of a fabric decolorization method in the related art.

In some aspects, a damage process for a textile product may include, but is not limited to, irradiating a laser beam onto a surface region of a textile product which is dyed, to burn the surface region, exposing the textile product to an ozone gas; and agitating the textile product together with at least one of: pieces of one or more solid materials having uneven surfaces and one or more abrasives of artificial fibers to allow the surface region to be shaved by the at least one of: the pieces of one or more solid materials and the one or more abrasives of artificial fibers.

In some cases, the damage process may further include carrying out one or more subsequent processes, without dipping the textile product into water or a liquid of chemicals, after agitating the textile product or without exposing the textile product to a flow of water or chemical liquid and until softening the textile product.

In some cases, agitating the textile product may include agitating the textile product together with both the pieces of one or more solid materials and the one or more abrasives of artificial fibers in the presence of the ozone gas, wherein the artificial fibers are made of a polymer containing aluminum oxide.

In some cases, the pieces of one or more solid materials are greater in hardness and mass-per-volume than the textile product, and the one or more abrasives of artificial fibers are greater in hardness and elasticity of fiber than the textile product.

In some cases, the damage process may further include, but is not limited to, exposing at least the surface region oxidized by the ozone gas to a mist of water to give a moisture to the textile product after exposing the textile product to the ozone gas and before agitating the textile product.

In some cases, exposing the at least surface region to the mist of water may include spraying, by a spray machine, water onto at least the surface region.

In some cases, the pieces of one or more solid materials are greater in total weight than the textile product and the one or more abrasives of artificial fibers are smaller in total weight than the textile product.

In some cases, the pieces of one or more solid materials are greater by at least two times in total weight than the textile product and the one or more abrasives of artificial fibers are smaller by at least two times in total weight than the textile product.

In some cases, the pieces of one or more solid materials may include, but is not limited to, pieces of a single type of artificial stone.

In some cases, the pieces of one or more solid materials may include, but is not limited to, a mix of pieces of different types of artificial stone.

In some cases, the pieces of one or more solid materials may include, but is not limited to, pieces of natural stone.

In some cases, the pieces of one or more solid materials may include, but is not limited to, pieces of natural stone.

In some cases, the pieces of the artificial fibers may include, but is not limited to, scourers.

In some cases, agitating the textile product is carried out in the presence of the ozone gas.

In some cases, agitating the textile product is carried out in the presence of the ozone gas having an ozone concentration of at least 40 g/M3 for at least 15 min.

In some cases, agitating the textile product may include, but is not limited to, rotating a rotatable vessel around a horizontal axis, while the rotatable vessel containing the textile product with the pieces of artificial stone and the pieces of the artificial fibers.

In some cases, agitating the textile product may include, but is not limited to, rotating the rotatable vessel, while the rotatable vessel containing the textile product with the pieces of artificial stone and pieces of scourers in the presence of the ozone gas having an ozone concentration of at least 40 g/M3-100 g/M3 for at least 10-30 min.

In some cases, agitating the textile product is carried out in a substantially ozone-free atmosphere after the at least surface region is oxidized by the ozone gas.

In other aspects, a method for decolorizing a cotton fabric may include, but is not limited to, irradiating a laser beam onto a surface region of a cotton fabric which is dyed, to burn the surface region; exposing the cotton fabric to an ozone gas having an ozone concentration of at least 40/M3 for at least 15 min. to oxidize at least the surface region that was irradiated with the laser beam; spraying, by a spray machine, water onto at least the surface region oxidized by the ozone gas; and agitating the cotton fabric given together with pieces of artificial stones having uneven surfaces and pieces of artificial scourers to allow the surface region to be shaved by the pieces of artificial stones and the pieces of artificial scourers, wherein the pieces of pieces of artificial stones are greater in hardness and mass-per-volume than the cotton fabric, and the pieces of artificial scrub brushes are greater in hardness and elasticity of fiber than the cotton fabric, and wherein the pieces of artificial stones are greater by at least two times in total weight than the cotton fabric and the one or more abrasives of artificial fibers are smaller by at least two times in total weight than the artificial scourers; drying the cotton fabric in air after agitating the cotton fabric; drying the cotton fabric in an ozone atmosphere after drying the cotton fabric in air; and softening the cotton fabric with an softener.

In still other aspects, a method for preparing a damage-processed textile product may include, but is not limited to, burning a surface region of a textile product which is dyed; oxidizing at least the surface region that was burned; and automatically shaving the at least surface region, which was oxidized, using at least one of: pieces of one or more solid materials having uneven surfaces and one or more abrasives of artificial fibers to allow the surface region to be shaved by the at least one of: the pieces of one or more solid materials and the one or more abrasives of artificial fibers; and carrying out one or more subsequent processes, without dipping the textile product into water or a liquid of chemicals or without exposing the textile product to a flow of water or chemical liquid, automatically shaving the at least surface region and until softening the textile product.

The term "textile" used herein refers to a flexible material consisting of a network of natural or artificial fibers such as yarn or thread. Yarn can be produced by spinning raw fibers of wool, flax, cotton, hemp, or other materials to produce long strands. Textiles are formed by weaving, knitting, crocheting, knotting, or felting. The terms "fabric" and "cloth" are used in textile assembly trades such as tailoring and dressmaking as synonyms for textile. However, there are subtle differences in these terms in specialized usage. A textile is any material made of interlacing fibers. A fabric is a material made through weaving, knitting, spreading, crocheting, or bonding that may be used in production of further goods such as garments, etc. A typical example of "textile" may be, but is not limited to, denim which is a sturdy cotton warp-faced textile in which the weft passes under two or more warp threads. This twill weaving produces a diagonal ribbing that distinguishes it from cotton duck. The most common denim is indigo denim, in which the warp thread is dyed, while the weft thread is left white. As a result of the warp-faced twill weaving, one side of the textile is dominated by the blue warp threads and the other side is dominated by the white weft threads. This causes blue jeans to be white on the inside. The indigo dyeing process, in which the core of the warp threads remains white, creates denim's signature fading characteristics. Dry or raw denim is distinguished from washed denim is denim that is not washed after having been dyed during production. Over time dry denim will fade, considered fashionable in some circumstances. During the process of wear, fading will usually occur on those parts of the article that receive the most stress. On a pair of jeans, this includes the upper thighs, the ankles, and the areas behind the knees. After being made into an article of clothing, most denim articles are washed to make them softer and to reduce or eliminate shrinkage. In addition to being washed, "washed denim" is sometimes artificially distressed to produce a "worn" look. Much of the appeal of artificially distressed denim is that it resembles dry denim which has faded. In jeans made from dry denim, such fading is affected by the body of the person who wears them and by the activities of their daily life. This process creates what many enthusiasts feel to be a look more "natural" than artificially distressed denim.

The term "surface region" used with the term "textile" refers to a three-dimensional region having a non-zero thickness, but not two-dimensional region without thickens, of a piece of textile having a thickness, wherein the shallow region is thinner than the piece of textile. The shallow region is shallower by a half depth of the piece of textile.

The term "dye" used herein refers to a colored substance that has an affinity to a substrate, a piece of textile, to which the colored substance is being applied. The dye can be generally applied in an aqueous solution, and may require a mordant to improve the fastness of the dye on the fiber of the piece of textile. Both dyes and pigments are colored because the both absorb only some wavelengths of visible light. Dyes are usually soluble in water whereas pigments are insoluble. Some dyes can be rendered insoluble with the addition of salt to produce a lake pigment.

The term "burn" used herein refers to providing a substantive damage to the fiber of the piece of textile by heating the fiber of the piece of textile, but not by cooling, not chemically, not electrically and not frictionally. Typically, the term "burn" used herein refers to such the substantive damage to the fiber of the piece of textile as to brown the surface region of the piece of textile.

The phrase "irradiating a laser beam onto a surface region of a textile product, to burn the surface region" refers to providing, by a laser beam irradiation, a substantive heat-damage to the fiber of the piece of textile to burn the surface region of the piece of textile, typically brown the surface region of the piece of textile.

The term "ozone gas" used herein refers to a gas containing $O_3$, which may include such other molecules as included in air as well as impurities.

The term "exposing" used herein refers to place the surface region of the textile product in a condition for allowing ozone gas, $O_3$, to contact with fibers of the surface region and allow an oxidation reaction to be caused with ozone, $O_3$, between molecules of the fibers of the surface region and ozone, $O_3$. The process for exposing the surface region of the textile product to the ozone gas is carried out to clean and desize the surface region of the textile product.

The term "agitating the textile product" refers to a way of agitating the textile product without dipping the textile product into water or any other liquids or without exposing the textile product to a flow of water or chemical liquid. In some cases, the process for agitating the textile product can be carried out in the presence of the ozone gas, while oxidization process is carried out. In other cases, the process for agitating the textile product can be carried out in the presence of the ozone gas having an ozone concentration of at least 40 g/M3 for at least 15 min, while oxidization process is carried out. In some cases, the way of agitating the textile product can be implemented by rotating in a rotational vessel or container that contains the textile product with at least one of; pieces of one or more solid materials and one or more abrasives of artificial fibers with a gas such as air or ozone gas and without dipping the textile product into water or any other liquids or without exposing the textile product to a flow of water or chemical liquid. For example, an agitator machine has a rotatable vessel configured to around a horizontal axis, while the rotatable vessel containing the textile product with the pieces of artificial stone and the pieces of the artificial fibers, without dipping the textile product into water or, any other liquids or without exposing the textile product to a flow of water or chemical liquid, resulting in agitation in a container or chamber. The agitator machine may optionally have an ozone blower which is configured to below ozone gas into an inner space defined by the vessel, without dipping the textile product into water or any other liquids or without exposing the textile product to a flow of water or chemical liquid, resulting in agitation in a container or chamber. In this case, the rotatable vessel rotates, while the rotatable vessel contains the textile product with the pieces of artificial stone and pieces of scourers in the presence of the ozone gas having an ozone concentration of at least 40 g/M3 for at least 15 min. In other words, the process for agitating the textile product can be carried out while allowing the surface region of the textile product to be oxidized with the ozone gas. In other cases, the process for agitating the textile product can be carried out in a substantially ozone-free atmosphere after the process for oxidizing the surface region of the textile product has been completed. Instead of rotating the rotatable vessel, the way of agitating the textile product can be implemented by using a gas blower for blowing air or ozone gas to cause agitation of the textile product with at least one of: pieces of one or more solid materials and one or more abrasives of artificial fibers, without dipping the textile product into water or any other liquids or without exposing the textile product to a flow of water or chemical liquid, resulting in agitation in a container or chamber. In still other cases, the way of agitating the textile product can be implemented by using agitator tools such as agitator rod or rods to move for agitation in the absence of water or any liquids, without dipping the textile product into water or any other liquids or without exposing the textile product to a flow of water or chemical liquid, to agitate the textile product with the at least one of: pieces of one or more solid materials and one or more abrasives of artificial fibers.

The term "solid materials having uneven surfaces" refers to pieces of hard or ridged objects having uneven surfaces which may cause physical frictions and shave the textile product when the pieces of hard or ridged objects get contact with the textile product while agitating the textile product in the last-mentioned way of agitation in the absence of water or any liquids, without dipping the textile product into water or any other liquids or without exposing the textile product to a flow of water or chemical liquid. The pieces of one or more solid materials are greater in hardness and mass-per-volume than the textile product, to enhance the effects of shaving the surface region of the textile product. The one or more solid materials are put in the agitator machine at such an amount that the pieces of one or more solid materials are greater in total weight than the textile product, to enhance the effects of shaving the surface region of the textile product. In some cases, the pieces of one or more solid materials are greater by at least two times in total weight than the textile product. Typical examples of "the solid materials having uneven surfaces" may include, but are not limited to, natural or artificial stones. For environmental perspective, artificial stones such as eco-stones may be useful since the artificial stones are in general more unlikely to be broken and are likely to have a greater durability than natural stones.

The term "one or more abrasives of artificial fibers" refers to pieces of scourer of fibers or scrubber of fibers. Typical examples of the artificial fibers may include, but are not limited to, spun polymer fibers such as spun polypropylene fibers. The one or more abrasives of artificial fibers are greater in hardness and elasticity of fiber than the textile product, to enhance the effects of shaving the surface region of the textile product. In order to increase the hardness of spun polypropylene fibers to enhance shaving effects, the artificial fibers are made of a polymer containing aluminum oxide. Aluminum oxide has one of the highest hardness coefficients of all oxides, though the much more expensive diamond abrasives still exceed it in hardness. The one or more abrasives of artificial fibers are put in the agitator machine at such an amount that the one or more abrasives of artificial fibers are smaller in total weight than the textile product. In some cases, the one or more abrasives of artificial fibers are smaller by at least two times in total weight than the textile product. The "one or more abrasives of artificial fibers" can be used in any forms such as pieces of pad, and pieces of sheet. Scotch-Brite, a line of abrasive cleaning pads produced by 3M can be commercially available, for example. Scotch-Brite also contains aluminum oxide. Although polypropylene may be considered benignly soft, its composition with aluminum oxide greatly enhances its abrasive powers; to the extent that a Scotch-Brite pad will actually scratch glass.

The term "softening" used herein refers to a process for softening the textile product with a fabric softener that is a chemical compound that is typically applied to laundry during the rinse cycle in a washing machine. In contrast to laundry detergents, fabric softeners may be regarded as a kind of after-treatment laundry aid, along with soil and stain removers, water softeners, bleaches, fabric stiffeners, and fabric fresheners.

The term "a mist of water" used herein refers to a phenomenon caused by small droplets of water suspended in air or a gas. Physically, it is an example of a dispersion. It can be created artificially with a spray or aerosol canisters if the humidity and temperature conditions are right. Aerosol spray or spray machine is a type of dispensing system which creates an aerosol mist of liquid particles. This is used with a can or bottle that contains a payload and propellant under pressure. The process for exposing at least the surface region oxidized by the ozone gas to a mist of water is carried out to give a moisture to the textile product after exposing the textile product to the ozone gas and before agitating the textile product.

Examples

Figure 2:
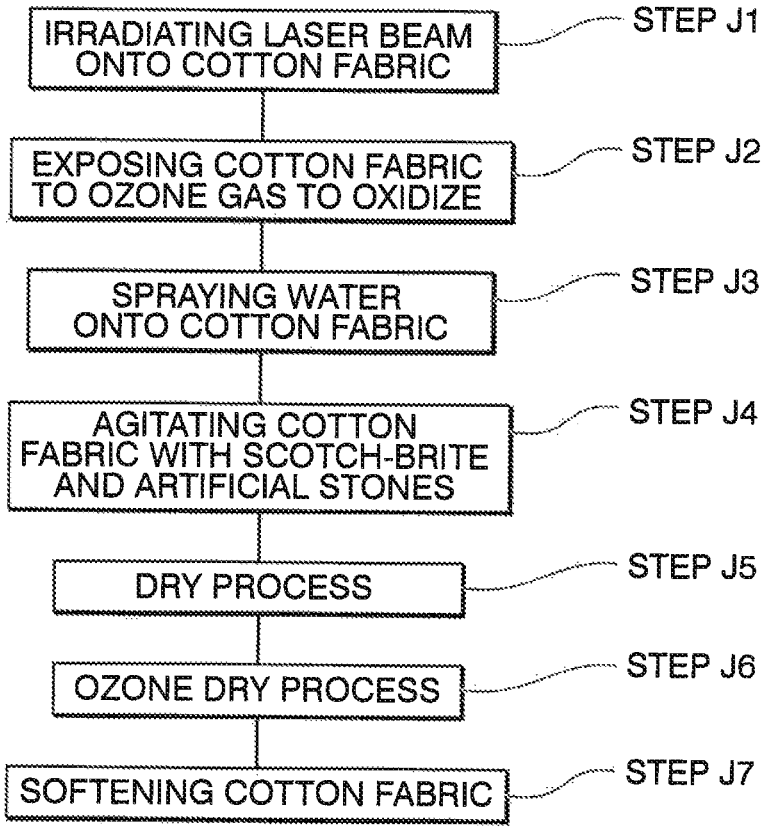
FIG. 2 is a flow chart of a fabric decolorization method in example of the present invention.

FIG. 2 is a flow chart of a fabric decolorization method in example of the present invention. The cotton fabric decolorization method includes a series of dry processes and a subsequent series of wet processes.

Dry Processes:

The dry processes include only the following single step, Step J1, In Step J1, a laser beam is irradiated onto a surface region of a cotton fabric which is dyed, to burn the surface region of the cotton fabric. The energy of the laser beam can be determined to brown the surface region of a cotton fabric.

The purpose of irradiating the laser beam onto the surface region of a cotton fabric is to burn and brown the surface region of the cotton fabric. For example, a laser beam is scanned onto the surface region of the cotton fabric to give heat to burn the fabric. An estimated operating time for irradiating a laser beam onto a surface region of a cotton fabric depends at least in part upon an area which receives the irradiations. For example, in case of jeans, the estimated operating time for irradiating the laser beam is about 2 min. This laser beam irradiation process in Step J1 will provide similar physical effects on changing the status of the surface of the cotton fabric as the dry process of the above-described processes in Step C1, Step C2, and Step C3. For example, 15,000 pieces of dyed cotton fabric such as denim fabric are dry-processed using 20 of laser devices per day. Thus, the estimation of the cost for the dry process using the laser beam irradiation will be about 0.5 US Dollars per a piece of dyed cotton fabric such as denim fabric. The dry process in Step J1 costs for about 0.5 US Dollars per a piece of dyed cotton fabric, while the dry processes in Steps C1 to C3 cost for about 1.5 US Dollars per a piece of dyed cotton fabric. The dry process in Step J1 is approximately one third of the dry process in Steps C1 to C3.

Wet Process:

The wet process is carried out, following to the dry process. The wet process includes the following fourth to eleventh steps, Step J2 through Step J7, subsequent to the above-described single step, Step J1 for the dry process. The wet process is carried out without dipping the cotton fabric into water or without exposing the cotton fabric to a flow of water or chemical liquid.

In Step J2, the cotton fabric is exposed to an ozone gas to oxidize at least the surface region burned with the laser beam irradiation, so as to clean the laser-burn and to desize the surface region burned with the laser beam irradiation. No water is used in the ozone gas exposure process in Step J2. The ozone gas exposure process in Step J2 will provide similar physical and chemical effects on changing the status of the surface of the cotton fabric as the above-described processes in Step C3, and Step C4. The ozone gas has such a high concentration of ozone as to oxidize the at least the surface region burned with the laser beam irradiation. The oxidation reaction will depend upon the concentration of ozone in the ozone gas and the time for exposing the at least the surface region to the ozone gas. The process for exposing the surface region of the cotton fabric to the ozone gas can be carried out by using an ozone gas supply machine configured to supply the ozone gas to place the cotton fabric in the ozone gas. Typically, the ozone gas supply machine can be implemented by an ozone gas spray machine or an ozone gas blower machine. In this process for exposing the surface region of the cotton fabric to the ozone gas can be carried out together with abrasives of artificial fibers containing aluminum oxide such as Scotch-Brite, a line of abrasive cleaning pads produced by 3M can be commercially available, for example. The ozone gas may have an ozone concentration in the range of 40 g/M3-100 g/M3, but no limited to, a preferable concentration of about 40 g/M3 In case of the ozone concentration of about 40 g/M3, the estimated operating time for exposing the cotton fabric to such ozone gas is in the range of 15-30 min. but not limited to, a preferable time of about 45 min preferably. No water is used in the ozone gas exposure process in Step J2, even the above-described desizing process in Step C4 needs 1200 liters of water in total.

In Step J3, water is sprayed onto the surface region of the cotton fabric to give moisture to the surface region of the cotton fabric just for preparation of the next shaving process. Preferable, water is sprayed onto the surface region of the cotton fabric to wet the surface region of the cotton fabric in the range of 50-100%-wet pick. The process for spraying water onto the surface region of the cotton fabric is carried out without dipping the cotton fabric into water or without exposing the cotton fabric to a flow of water or chemical liquid. The process for spraying water onto the surface region of the cotton fabric is carried out for 15 min. with water consumption of 60 liters for 30 pieces of cotton fabric.

In Step J4, to modify the appearance, to impart worn-out look and to improve the comfort ability of the cotton fabric, especially denim fabric, the cotton fabric is put into a rotational vessel of an agitator machine together with pieces of Scotch-Brite and artificial stones, at a weight ratio of 24% of cotton fabric, 6% of Scotch-Brite and 70% of artificial stones. Then, the rotational vessel is rotated around substantially horizontal rotation axis at a rotational rate in the range of 16-40 rpm. for about 45 min. to agitate the textile product pieces of Scotch-Brite and artificial stones to cause physical frictions and shave the surface region of the cotton fabric when the pieces of hard or ridged objects get contact with the textile product, without dipping the textile product into water or any other liquids or without exposing the cotton fabric to a flow of water or chemical liquid. The agitating process in Step J4 will provide similar physical and chemical effects on changing the status of the surface of the cotton fabric as the above-described processes in Step C5, and Step C8. The agitating process is carried out for 45 min. with water consumption of 60 liters for 30 pieces of cotton fabric.

In Step J5, a drying process is then carried out in a dry air at a temperature in the range of 60-85° C. for about 45 min. The dry process in Step J5 will provide similar physical and chemical effects on changing the status of the surface region of the cotton fabric as the above-described processes in Step C6.

In Step J6, an ozone dry process is then carried out in an ozone gas at a temperature in the range of 20 g/M3 for about 15 min., to clean up back-stain, that happed in Step J4, from the surface region of the cotton fabric. The dry process in Step J6 will provide similar physical and chemical effects on changing the status of the surface region of the cotton fabric as the above-described processes in Step C9.

In Step J7, to make a hand-feel soft of the cotton fabric, a softening process for softening the cotton fabric with any available softener is carried out for about 15 min. with using 60 liters of water at 60 kg garment weight without dipping the cotton fabric into water or without exposing the cotton fabric to a flow of water or chemical liquid.

Water Consumption:

In total, 180 liters of water need to be used in the wet process for decolorization from Steps J2 to J7 at 60 kg garment weight for 30 pieces of cotton fabric, and total operating time is 180 min. for 30 pieces of cotton fabric. The last-mentioned series of the wet processes in Step J2 to Step J7 consume 180 liters of water in total which is 97% reduction from the above-mentioned series of the wet processes in Step C4 to Step C11.

Cost:

For 30,000 pieces of cotton fabric, 10 machines are used for 30.0 days. The estimated cost for the wet process is about 1.45 US Dollars for each piece of cotton fabric. The estimated total cost for the dry process and the wet process is about 1.95 US Dollars for each piece of cotton fabric.

While certain embodiments of the present inventions have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for decolorizing a cotton fabric, the method comprising:

irradiating a laser beam onto a surface region of a cotton fabric which is dyed, to burn the surface region;

exposing the cotton fabric to an ozone gas having an ozone concentration of at least 40 g/M3 for at least 15 min. to oxidize at least the surface region that was irradiated with the laser beam;

spraying, by a spray machine, water onto at least the surface region oxidized by the ozone gas, to wet the surface region of the cotton fabric in the range of 50-100%-wet pick; and agitating, without dipping the cotton fabric into water or any other liquids and without exposing the cotton fabric to a flow of water or chemical liquid, the cotton fabric given together with pieces of artificial stones having uneven surfaces and pieces of artificial scourers including artificial fibers of a polymer containing aluminum oxide to allow the surface region to be shaved by the pieces of artificial stones and the pieces of artificial scourers, wherein the pieces of artificial stones are greater in hardness and mass-per-volume than the cotton fabric, and the pieces of artificial scourers are greater in hardness and elasticity of fiber than the cotton fabric, and wherein the pieces of artificial stones are greater by at least two times in total weight than the cotton fabric and the artificial fibers are smaller by at least two times in total weight than the cotton fabric;

drying the cotton fabric in air after agitating the cotton fabric;

drying the cotton fabric in an ozone atmosphere after drying the cotton fabric in air; and softening the cotton fabric with a softener.

2. The method according to claim 1, wherein agitating the cotton fabric is carried out in the presence of the ozone gas.

3. The method according to claim 2, wherein agitating the cotton fabric is carried out in the presence of the ozone gas having an ozone concentration of at least 20 g/M3 for at least 15 min.

4. The method according to claim 1, wherein agitating the cotton fabric comprises rotating a rotatable vessel containing the cotton fabric with the pieces of artificial stones and pieces of artificial scourers in the presence of the ozone gas having an ozone concentration of at least 40 g/M3 for at least 15 min.

5. The method according to claim 1, wherein agitating the cotton fabric is carried out in a substantially ozone-free atmosphere after the surface region is oxidized by the ozone gas.

* * * * *